US010180018B1

(12) United States Patent
Simpson et al.

(10) Patent No.: US 10,180,018 B1
(45) Date of Patent: Jan. 15, 2019

(54) LOCKING CAP WITH PROCESSOR

(71) Applicant: Gatekeeper Innovation, Inc., Sacramento, CA (US)

(72) Inventors: Joseph Christopher Simpson, Lincoln, CA (US); Lilianna Zyszkowski, Southfield, MA (US)

(73) Assignee: GATEKEEPER INNOVATION, INC., Sacramento, CA (US)

( * ) Notice: Subject to any disclaimer, the term of this patent is extended or adjusted under 35 U.S.C. 154(b) by 123 days.

(21) Appl. No.: 15/076,548

(22) Filed: Mar. 21, 2016

Related U.S. Application Data

(60) Provisional application No. 62/136,501, filed on Mar. 21, 2015.

(51) Int. Cl.

| | |
|---|---|
| ***E05B 73/00*** | (2006.01) |
| ***E05B 37/02*** | (2006.01) |
| ***E05B 47/00*** | (2006.01) |
| ***B65D 55/14*** | (2006.01) |
| ***A61J 1/14*** | (2006.01) |
| ***A61J 1/18*** | (2006.01) |
| ***E05B 41/00*** | (2006.01) |
| ***E05B 17/10*** | (2006.01) |
| ***E05B 65/00*** | (2006.01) |
| ***E05B 49/00*** | (2006.01) |
| ***E05B 37/00*** | (2006.01) |

(52) U.S. Cl.

CPC ..... *E05B 73/0041* (2013.01); *A61J 1/1437* (2013.01); *A61J 1/18* (2013.01); *B65D 55/145* (2013.01); *E05B 17/10* (2013.01); *E05B 37/0058* (2013.01); *E05B 37/02* (2013.01); *E05B 41/00* (2013.01); *E05B 47/0001* (2013.01); *E05B 47/0004* (2013.01); *E05B 49/00* (2013.01); *E05B 65/006* (2013.01); *E05B 2047/0067* (2013.01); *E05B 2047/0072* (2013.01)

(58) Field of Classification Search

CPC .. E05B 37/00; E05B 37/0048; E05B 37/0058; E05B 37/02; E05B 37/025; E05B 47/00; E05B 47/0001; E05B 47/0002; E05B 47/0003; E05B 47/0004; E05B 73/00; E05B 73/0017; E05B 73/0041; E05B 39/00

See application file for complete search history.

(56) References Cited

U.S. PATENT DOCUMENTS

| | | | |
|---|---|---|---|
| 1,358,352 | A | 11/1920 | Wheelock |
| 2,009,216 | A | 7/1935 | Anibal |
| 3,151,756 | A | 10/1964 | Gruen |

(Continued)

FOREIGN PATENT DOCUMENTS

| | | | |
|---|---|---|---|
| CN | 2897860 | Y | 5/2007 |

OTHER PUBLICATIONS

First Office Action for CN 201080049649.2 (English and Chinese; dated Dec. 25, 2013 (15 pgs.).

(Continued)

*Primary Examiner* — Christopher J Boswell
(74) *Attorney, Agent, or Firm* — DLA Piper LLP (US)

(57) ABSTRACT

The locking cap is a processor controlled device with sensors that may be embedded in the locking cap or the closure. The locking cap may provide information on use and activity and the locking cap with the embedded processor and sensors may also allow remote actuation to open the locking cap.

14 Claims, 9 Drawing Sheets

(56) References Cited

U.S. PATENT DOCUMENTS

| | | | | |
|---|---|---|---|---|
| 3,426,932 | A | 2/1969 | Rouse | |
| 3,445,021 | A | 5/1969 | Johnson | |
| 3,684,117 | A | 8/1972 | Leopoldi et al. | |
| 3,843,007 | A | 10/1974 | Meyer | |
| 3,901,407 | A | 8/1975 | Mitchell et al. | |
| 3,998,078 | A | 12/1976 | Detwiler | |
| 4,366,687 | A | 1/1983 | Atkinson | |
| 4,383,425 | A | 5/1983 | Orabona | |
| 4,520,641 | A | 6/1985 | Bako | |
| 4,794,768 | A | 1/1989 | Moser et al. | |
| 4,829,796 | A | 5/1989 | Kim | |
| 4,907,430 | A | 3/1990 | Hong | |
| 4,984,698 | A | 1/1991 | Stuckey | |
| 5,277,325 | A | 1/1994 | Yan | |
| 5,493,279 | A * | 2/1996 | Dawson | E05B 39/00 340/5.32 |
| 5,911,764 | A | 6/1999 | Wei Kong | |
| 6,688,146 | B2 | 2/2004 | Michels et al. | |
| 6,786,346 | B1 | 9/2004 | Gurnard et al. | |
| 6,793,081 | B1 | 9/2004 | Derman | |
| 6,912,878 | B2 | 7/2005 | Beldeti, Jr. | |
| 6,988,642 | B2 | 1/2006 | Gallo, Jr. et al. | |
| 7,243,515 | B2 * | 7/2007 | Meyer | E02D 29/1427 404/25 |
| 7,350,655 | B2 | 4/2008 | Belden, Jr. | |
| 7,677,065 | B1 * | 3/2010 | Miao | E05L 337/02 439/133 |
| 7,891,220 | B2 | 2/2011 | Yen | |
| 8,020,415 | B2 | 6/2011 | Corbin | |
| 8,662,330 | B2 | 3/2014 | Simposn | |
| 8,931,652 | B2 | 1/2015 | Small | |
| 8,938,999 | B2 | 1/2015 | Dahl | |
| 8,944,263 | B1 | 2/2015 | Michels et al. | |
| 9,133,649 | B2 * | 9/2015 | Taylor | E05L 347/0001 |
| 9,199,773 | B2 | 12/2015 | Simpson | |
| 9,278,789 | B2 | 3/2016 | Simpson | |
| 9,367,984 | B2 * | 6/2016 | Daugbjerg | G06F 19/3462 |
| 9,452,872 | B2 | 9/2016 | Simpson | |
| 9,573,743 | B2 | 2/2017 | Simpson | |
| 9,758,989 | B1 * | 9/2017 | Simpson | B65D 55/145 |
| 2003/0089145 | A1 | 5/2003 | Michels et al. | |
| 2004/0011098 | A1 | 1/2004 | Yang | |
| 2006/0207958 | A1 | 9/2006 | Hamer | |
| 2007/0131007 | A1 * | 6/2007 | Hacker | E05B 39/00 70/433 |
| 2008/0098939 | A1 | 5/2008 | Kalous et al. | |
| 2008/0302794 | A1 | 12/2008 | Wagner et al. | |
| 2009/0108016 | A1 * | 4/2009 | Brown | A61J 7/0084 221/28 |
| 2011/0049079 | A1 | 3/2011 | Simpson | |
| 2011/0049080 | A1 | 3/2011 | Simpson | |
| 2011/0079058 | A1 | 4/2011 | Nielsen | |
| 2011/0210136 | A1 * | 9/2011 | Wang | B65D 55/145 220/831 |

OTHER PUBLICATIONS

PCT/US2010/047589 International Preliminary Report Search Report dated Mar. 6, 2012 (7 pages).

PCT International Search Report of PCT/US10/47589; dated Oct. 22, 2010 (2 pgs.).

PCT Written Opinion of PCT/US10/47589; dated Oct. 22, 2010 (6 pgs.).

Extended European Search Report of EP 10814459.3; dated Dec. 12, 2012 (4 pages).

* cited by examiner

LOCKING CAP WITH PROCESSOR

PRIORITY CLAIMS/RELATED APPLICATIONS

This application claims the benefit under 35 USC 119(e) and priority under 35 USC 120 to U.S. Provisional Patent Application Ser. No. 62/136,501, filed Mar. 21, 2015 and entitled "Locking Cap with Processor", the entirety of which is incorporated herein by reference.

FIELD

The disclosure relates generally to a locking cap that may have sensors and a processor embedded into the locking cap.

BACKGROUND

A need exists to provide a security device to reduce unauthorized teenage, or other unauthorized user, from taking other people's prescription drugs. The unauthorized user is likely to abuse the prescription drug. There is a problem with unauthorized users taking potentially harmful and addictive prescription medications from unmonitored medicine cabinets. People are unaware about how vulnerable their prescriptions can be when the only security device protecting them is a child proof cap. Thus, it is desirable to add a security measure to a bottle. With a more secure bottle, fewer unauthorized users will have access to potentially dangerous and addictive medications. The device prevents an unauthorized user from taking a few pills that could go unnoticed by the prescription drug holder. For example, the security device can be broken in order to gain access, but this action would be noticeable by the prescription drug holder, and therefore further security actions can be taken.

There is further an adherence issue for prescriptions in which it is desirable to be able to provide reminders of actions to be taken, when actions are taken and/or reporting actions taken since compliance is a significant problem.

DETAILED DESCRIPTION OF ONE OR MORE EMBODIMENTS

The disclosure is particularly applicable to a locking cap with embedded sensors and a processor used to prevent unauthorized access to medical prescriptions and compliance and it is in this context that the disclosure will be described. It will be appreciated, however, that the locking cap may be used to secure any other types of content in a container and the locking cap can be of different sizes and shapes to fit onto various different shaped containers.

The locking cap is a processor, such as a microprocessor or a microcontroller, etc., controlled device with sensors that may be embedded in the locking cap or the closure and this locking cap may provide information on use of the locking cap and the activity of the user. The locking cap with the embedded processor and sensors may also allow remote actuation to open or close the locking cap. This locking closure/cap allows a user to secure medication or other substances in a container, then have access to the medication or substances using a manual mechanical combination lock or an automated remote control. The remote opening/closing feature can be user to extract and store valuable use information in the locking cap or that is then sent to a remote computing device.

Figure 1:
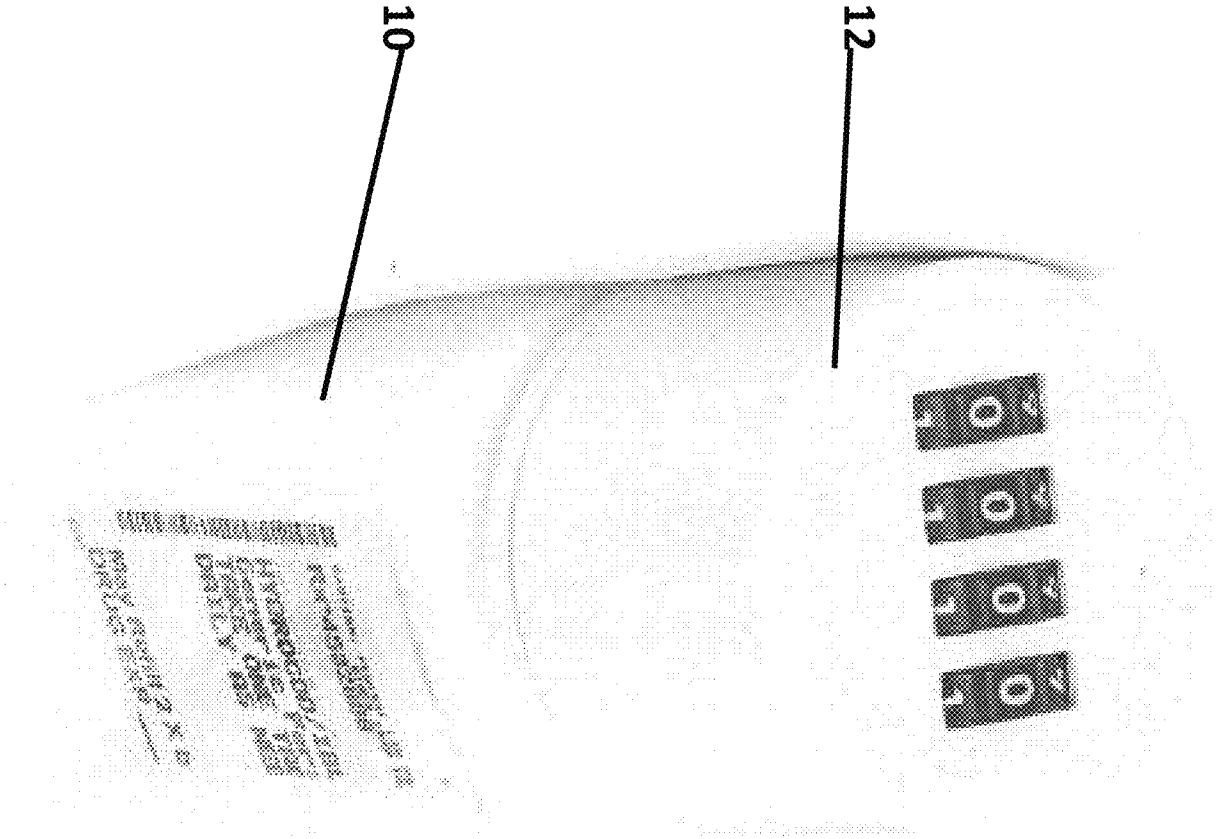
FIG. 1 illustrates container, such as for example a medical prescription bottle, that has a locking cap.

FIG. 1 illustrates a container 10, such as for example a medical prescription bottle, that has a locking cap 12 installed on the bottle to prevent authorized access to the contents inside of the container, such as for example prescription drugs in the bottle. In this example, the locking cap 12 may have a 4 dial combination lock as shown and the 4 dial combination lock and its operation are described in more detail in U.S. Pat. No. 8,931,652 (owned by the same assignee as this application) which is incorporated herein by reference.

Figure 2:
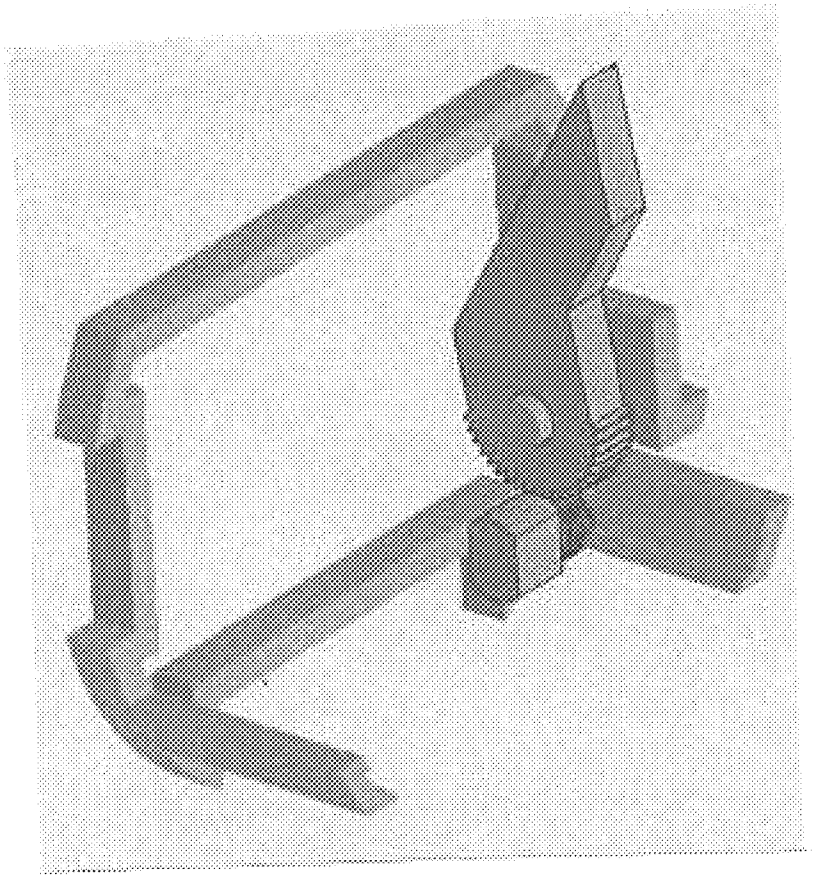
FIG. 2 is a mechanical portion of the locking cap.
Figure 3:
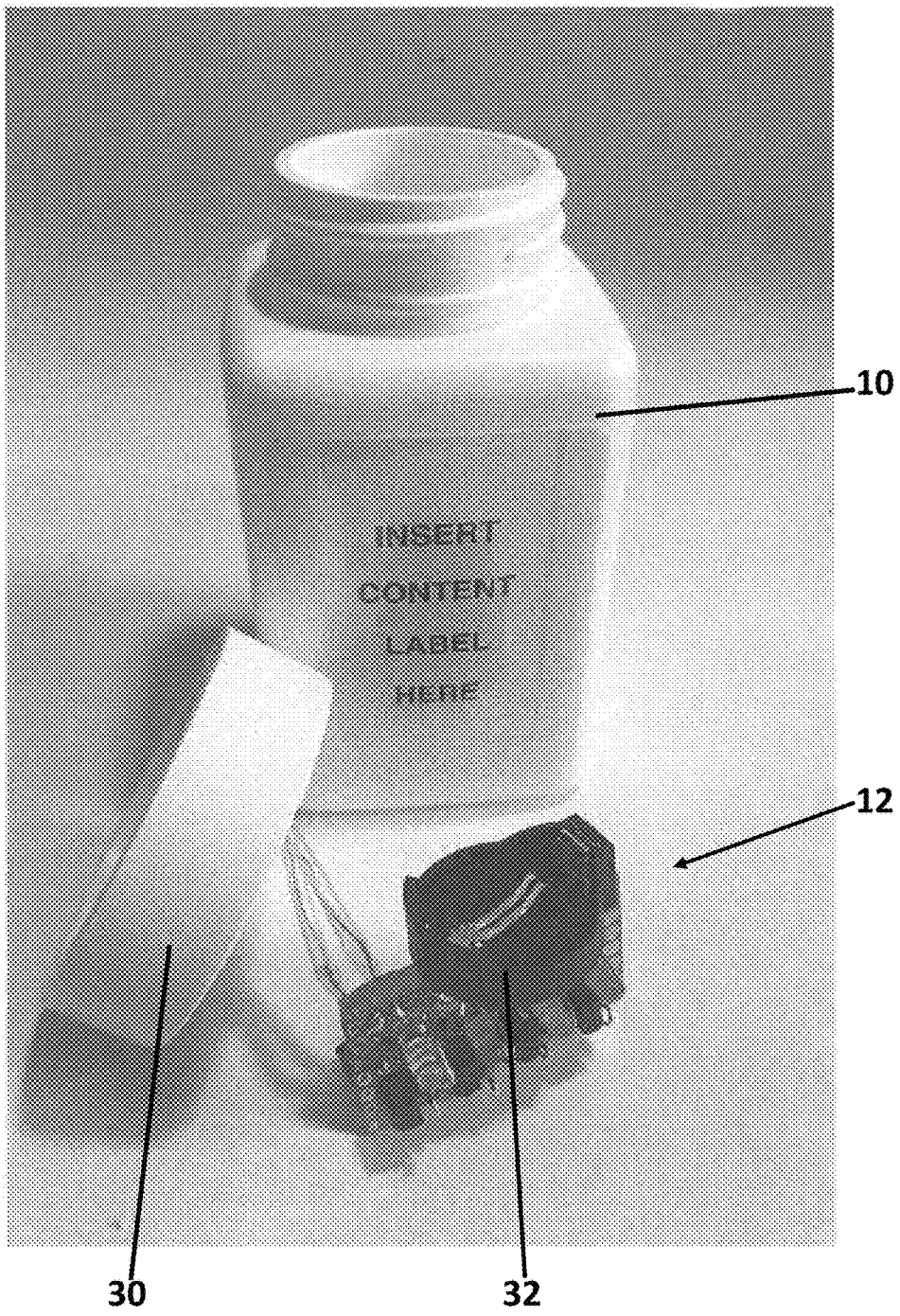
FIG. 3 shows more details of a locking cap with sensors and the processor embedded into the locking cap.

FIG. 2 is a mechanical portion of the locking cap and FIG. 3 shows more details of a locking cap with sensors and the processor embedded into the locking cap. As shown in FIG. 3, the locking cap 12 may have a cap/closure 30 and electronic circuits 32 that may be housed within the cap/closure. The electronic circuits 32 may include a processor, one or more sensors including a capacitive touch sensor, one or more lights, such as LEDs and connectivity circuits that allow the electronic circuits 32 to communicate with an external device. The electronic circuits 32 may, for example, actuate the lock/unlock device located in a cap 30 based on users' schedule. The electronic circuits 32 also may light up different lights in the cap to indicate a taking status for the user of the locking cap. The electronic circuits 32 may send notifications, such as a need of the user to take medication or action now, late for medication or action or notification that a taking, medication or action taken on time. The electronic circuits 32 may also be used to communicate pill taking status and time/log from the locking cap to a mobile device (phone, tablet) of a care taker, doctor and/or hospital. The locking cap may use a capacitive touch sensor to monitor pill taking status. The locking cap may also provide secure authentication of user based on data collected from the registered mobile device and electronic circuits 32 in the cap.

The electronic circuits 32 may also include software (a plurality of lines of computer code or microcode) that may be executed by the processor of the electronic circuit 32 to configure the processor to provide different functions. For example, the software may provide interfaces with time, frequency, compliance and reporting systems and may provide authentication of authorized users.

The locking cap may include a mechanical locking closure (the combination lock) as well as the electronic circuits with an actuator shown in FIG. 2. With an electrical impulse a push solenoid is triggered to engage the lower cap. The processor of the electronic circuits may store information both when it is used to open the closure and when the mechanical combination is used to open the locking cap. The processor of the electronic circuits is contained within the combination locking closure, together they allow multiple ways for a user to access the substance requiring security. Thus, the locking cap provides a mechanical and digital locking mechanism to protect medications and other substances by putting in the container with the lock.

The locking cap may register with remote devices/emails/websites/corporate systems. Thus, the locking cap may be used with digital health records or any electronic record system. The locking cap thus can be used for compliance on controlled substances and it can be used for reporting proper and improper uses of the medication/substance. The remote use of any bottle or container can be used that may need reporting or compliance or just provide information. In addition, employee management is another use of the locking cap.

Figure 4:
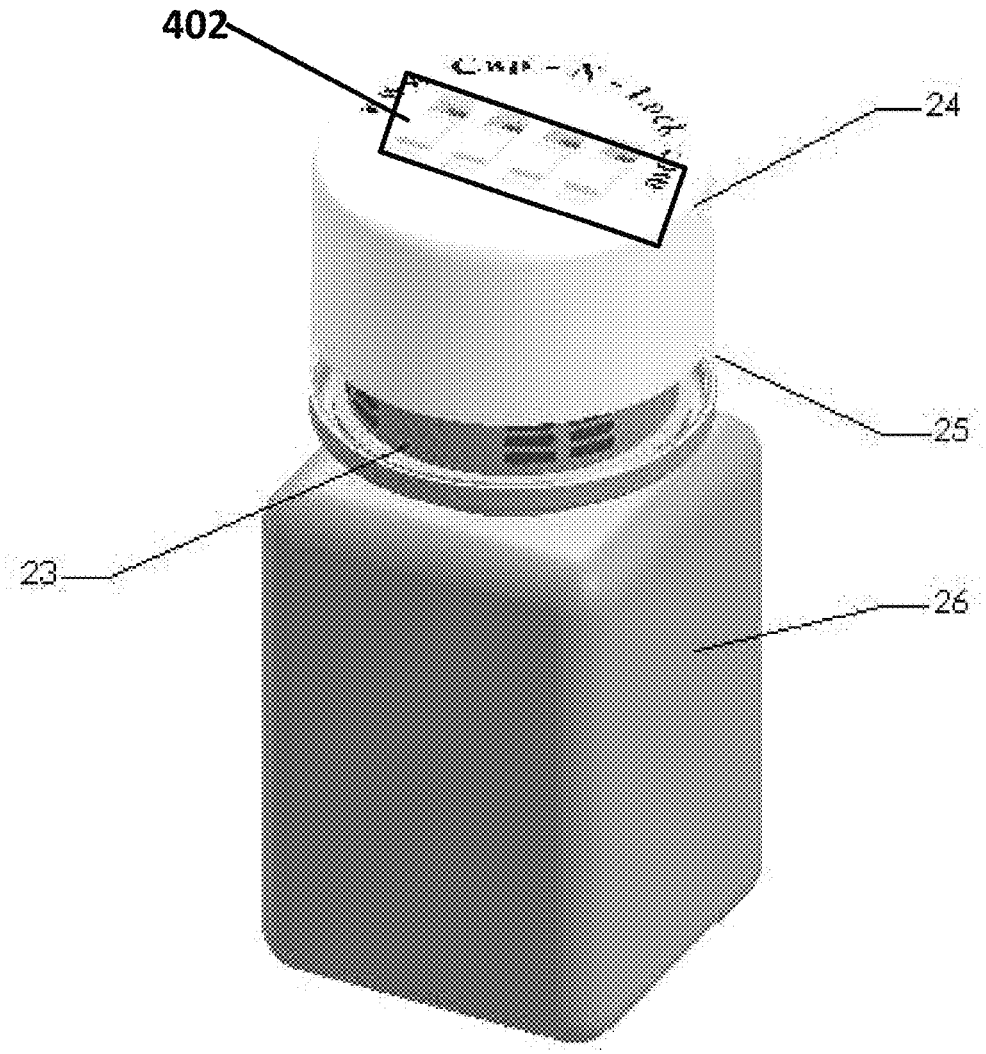
FIG. 4 illustrates a second embodiment of a container that has a locking cap.

FIG. 4 illustrates a second embodiment of a container 400, such as a medical prescription bottle as shown in FIG. 4, that has a locking cap 24. The locking cap 24 is not limited to any particular type of container and may be used to lock any container in which it is desirable to prevent unauthorized opening of the container. To the extent that the container 26 has a different shape and/or size than shown in FIG. 4, the locking cap 24 would also change in shape and/or size for the particular container shape and/or size. As with the first embodiment in FIGS. 1-3, the locking cap can perform the following operations: 1) lock the container from authorized access to the contents of the container; 2) unlock the container when the proper combination code or remote authorization is received; 3) allow the combination code to be reset and/or changed; and 4) the various other functions described above for the first embodiment. As with the first embodiment, the locking cap 24 has a set of combination dials 402 (four in one embodiment) that allows a user to set/reset a combination code, select the correct combination code to open the container or change the combination code on the combination dials to lock the container. The locking cap may have one or more cogs 502 that may be used to the functions described above. The locking cap 24 may further comprise an electromechanically locking mechanism 23 integrated into the locking cap 24 and a bottom portion 25 that retains the electromechanical locking mechanism 23 adjacent the locking cap 24.

Figure 5A:
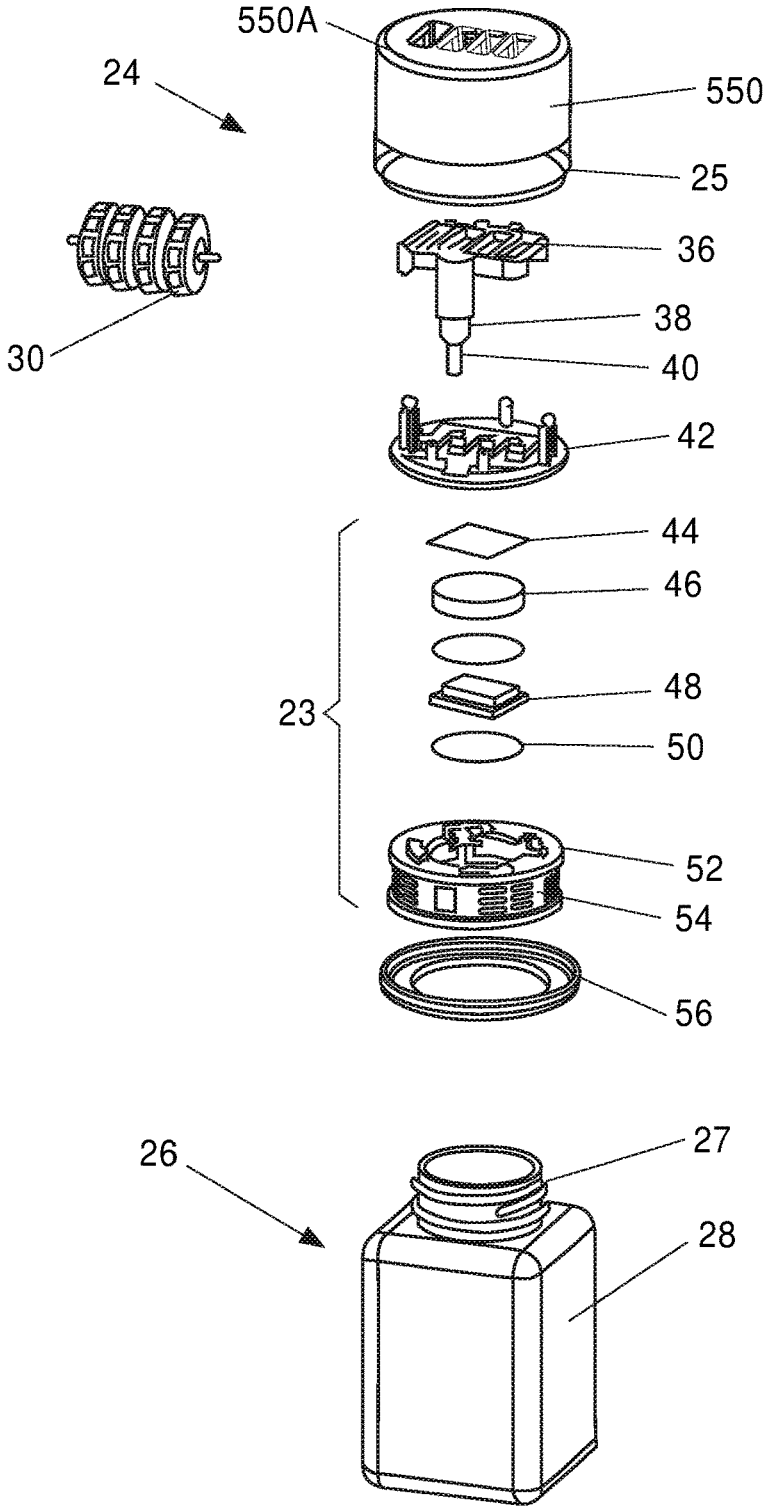
FIG. 5A is an exploded assembly diagram of the second embodiment of a container that has a locking cap.

FIG. 5A is an exploded assembly diagram of the second embodiment of the container 26 that has the locking cap 24 with the electromechanical locking mechanism 23. The container 26 may have a threaded portion 27 onto which the locking cap 24 engages to prevent the container from being opened absent a proper combination code or remote open command to the electromechanical locking mechanism 23 and a container body 28 that retains the contents within the container.

Figure 5B:
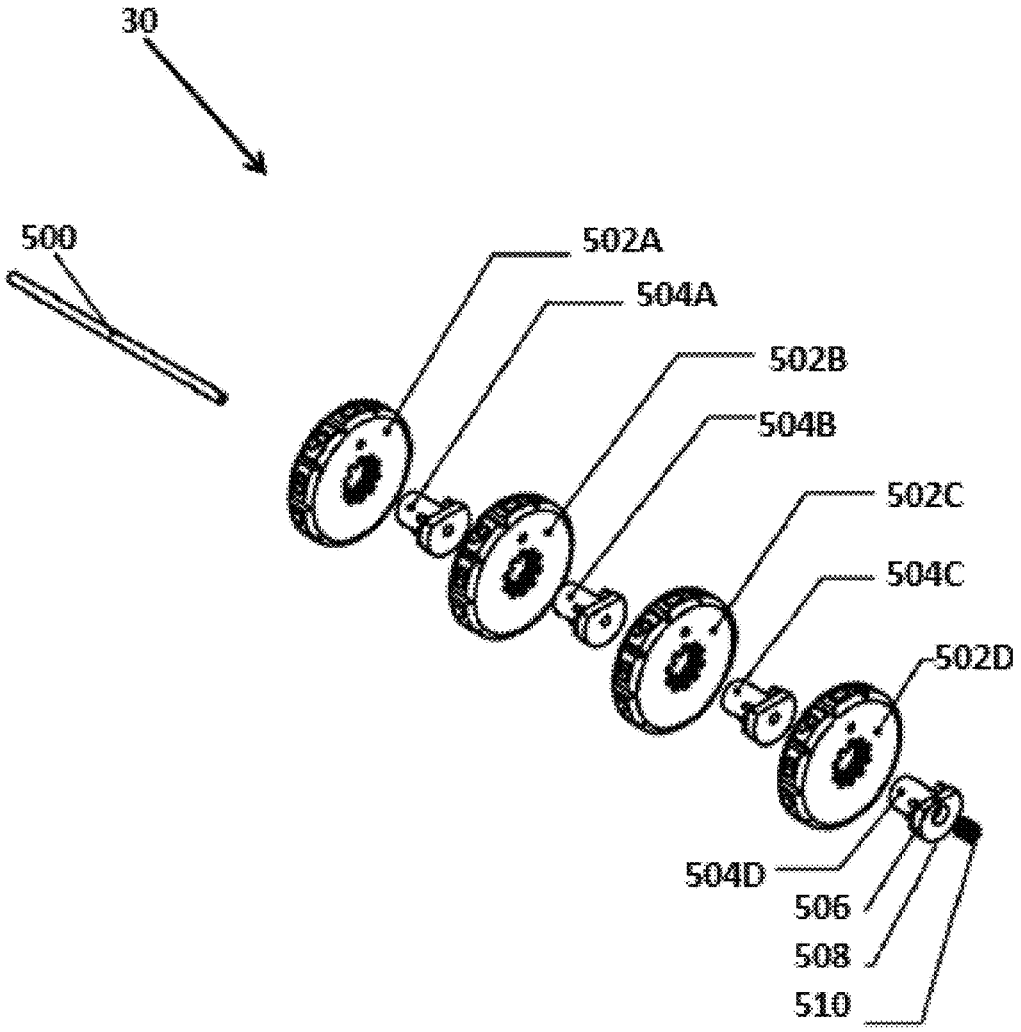
FIG. 5B illustrates further details of the combination lock that is part of the locking cap in FIG. 5A.

As shown in FIG. 5A, the locking cap may further comprise a set of cogs and cams 30 which is shown in more detail in FIG. 5B. The set of cogs and cams 30 may have one or more cogs 502 (cogs 502*a*, 502*b*, 502*c* and 502*d* in one implementation with a 4 cog combination lock as shown in FIGS. 5A and 5B) and one or more cams 504 (cams 504*a*, 504*b*, 504*c*, and 504*d* in one implementation) that fit inside of one or more cogs. Each cog 502 may have alphanumeric representation or other type of symbol on each side of the cog to allow the user to set a combination to open the locking cap 24 manually, open the locking cap 24 by setting the cogs to the correct sequence of symbols and lock the cap. The cams and numeric cogs then slide onto a wheeled axel 500 and the assembled parts are placed into a set of slots in a housing 550 that support the cogs, cams and the wheeled axel in the housing. Once the cogs, cams and the wheeled axel are in the housing 550, a spring 510 holds the cams firmly against the numeric cogs. Each cam 504 may have flat portion and a rounded portion. In operation, when the flat surface of all the cams 504 are aligned with the flat surfaces facing upward (as shown in FIG. 5B), the system is unlocked. When even one cam is rotated so the round portion of the cam 504 is facing up, a lock plate 36 is held upward and the device is locked.

Returning to FIG. 5A, the locking cap 24 further comprises the lock plate 36 that is located above the set of cams and cogs 30 when the locking cap 24 is assembled. Thus, after the assembled cogs, cams and wheeled axel are in the housing 550 of the locking cap, the lock plate 36 is placed on top of the assembled cogs, cams and wheeled axel. The lock plate has an extension 38 as shown in more detail in FIG. 5A such that the lock plate 36 pivots depending on the positioning of the one or more cams 504, shown unlocked in FIG. 5B since the lock plate 36 would be positioned down when it is unlocked.

The cam 504*d* in FIG. 5B shows how the locking system works. In particular, when all the cams 504 are aligned with the flat surfaces facing upward with the faces of the cogs (as shown in FIG. 5B), the system is unlocked. When even one cam is rotated so the round portion of the cam 508 is facing up, the lock plate 36 is held upward and the device is locked.

The locking cap may further comprise a reset mechanism that allows the user to reset the combination lock. The device may thus have a reset pin that allows the user to reset the numerical combination to which the cogs must be turned (1234, for example in this implementation) by the user to open the device. The reset pin does not need to be a specific shape as any element/pin inserted into the reset hole would work (as long as the system is unlocked). To reset the cap locking device, the device must be unlocked (lock plate down in one embodiment) and the user puts the reset pin 93 through the reset hole of the housing. The reset pin then passes through the reset indent/outlet, and comes in contact with the cam 504*a*. All the cams 504*a*, 504*b*, 504*c*, 504*d* are able to move slightly along the axel. The cams 504*a*, 504*b*, 504*c*, 504*d* are held against their corresponding numeric cog by the spring 510 which sits at opposing end of the axel 500. The reset pin pushes the cams which move together compressing the spring 510 at the far end. The slight offset of the cams from the numeric cogs forced by the reset pin and allowed by the compression of the spring 510 permits the numeric cogs to spin independent from the cams. When the numeric cogs spin independent from the cams the user can reset the system to a new combination. With the new combination aligned across the center of the cap the user releases the reset pin which causes the cams to slide back into place with the numeric cogs. The spring 510 causes the numeric cogs and cams to pair making them spin dependently with each other, thus allowing users to personalize the numbers. A user can only reset to a personal combination when the system is unlocked. The locking plate can be in two positions, up (locked) or down (unlocked).

Once the cam assembly and locking plate are placed into the housing, a housing cover 550A is attached to the housing 550. The housing cover 550A holds the components of the numeric cogs and the lock plate in place in the device. The numeric cogs 502 stick above the housing cover 550A when the device is assembled so that a user can spin the cogs on their axel. The device has, below the housing cover when the device is assembled, a dog cap 42. The dog cap 42 slips into the housing 550 from the bottom and spins freely (when locked) within the housing. To hold the dog cap in the housing, a lower housing 56 is attached to the lower part of the housing. The dog cap 42 is slightly smaller than the housing that contains it which allows the dog cap 42 to spin freely (when locked) within the housing. When unlocked, a lock arm 40 of the lock plate 36 engages the dog cap 42 allowing the user to put tension on the cap and remove the cap from the container to which the locking cap 24 is attached. To attach the locking cap 24 onto the container 26, the user twists an unlocked cap onto a bottle, twists tight, and then mixes up the numbers which lifts the lock plate 36 and allows the dog cap 42 to spin freely thus locking the cap and access to the contents of the container. This allows for a greater safety and security measure for the contents within any container 90 since unlocking the cap requires the numerical code as well as being able to push down the cap and remove it from the bottle. When the locking cap is in an unlocked position, the lock plate 36 moves downward and interacts with the extensions on the dog plate 52 (shown in FIG. 5C) and allows the dog plate 52 to be twisted and thus open the locking cap 24.

Figure 6:
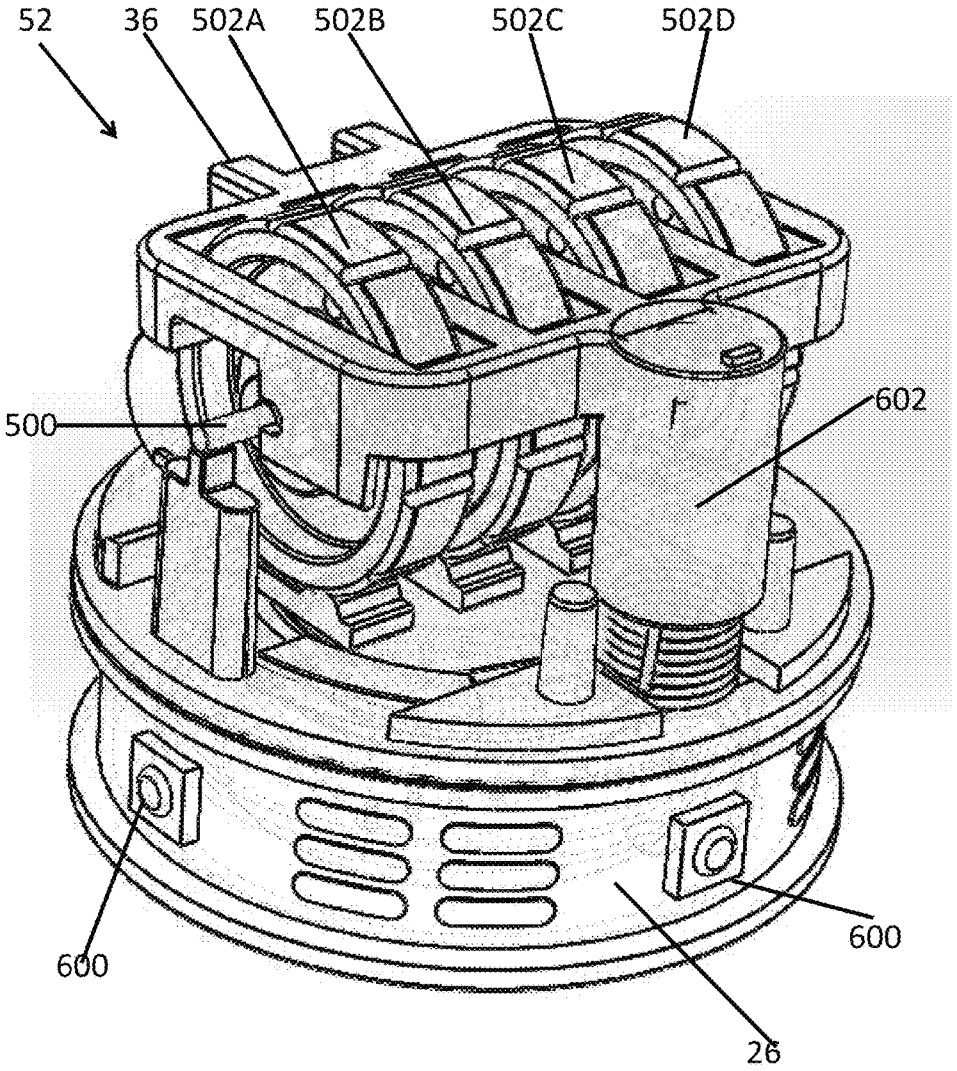
FIG. 6 illustrates further details of the cap portion of the second embodiment of a container that has a locking cap.

The electromagnetic locking components 52 further includes a processor 48, such as any commercially available microprocessor or microcontroller, that controls the operation of the electromagnetic locking components 52. In particular, the processor 48 may receive a remote command (such as over a wireless communications path like Bluetooth) to open the container and may then provide a signal/command to a solenoid 602 (shown in FIG. 6) to open the container. For example, this may occur when it is time for the user of the contents of the container to take his/her next medication that is in the container. As described above, the electromagnetic locking components 52 may also have or more visible indicators 54, such as LEDs, that may be integrated into the housing and are also controlled by the processor and may indicate that it is time to take a next medication to the user, for example. In the locking cap, the "manual" unlocking feature (using the combination lock) works independently from the electronic unlocking. Thus, if the electronic components fail the manual combination will still open the lock.

Figure 5C:
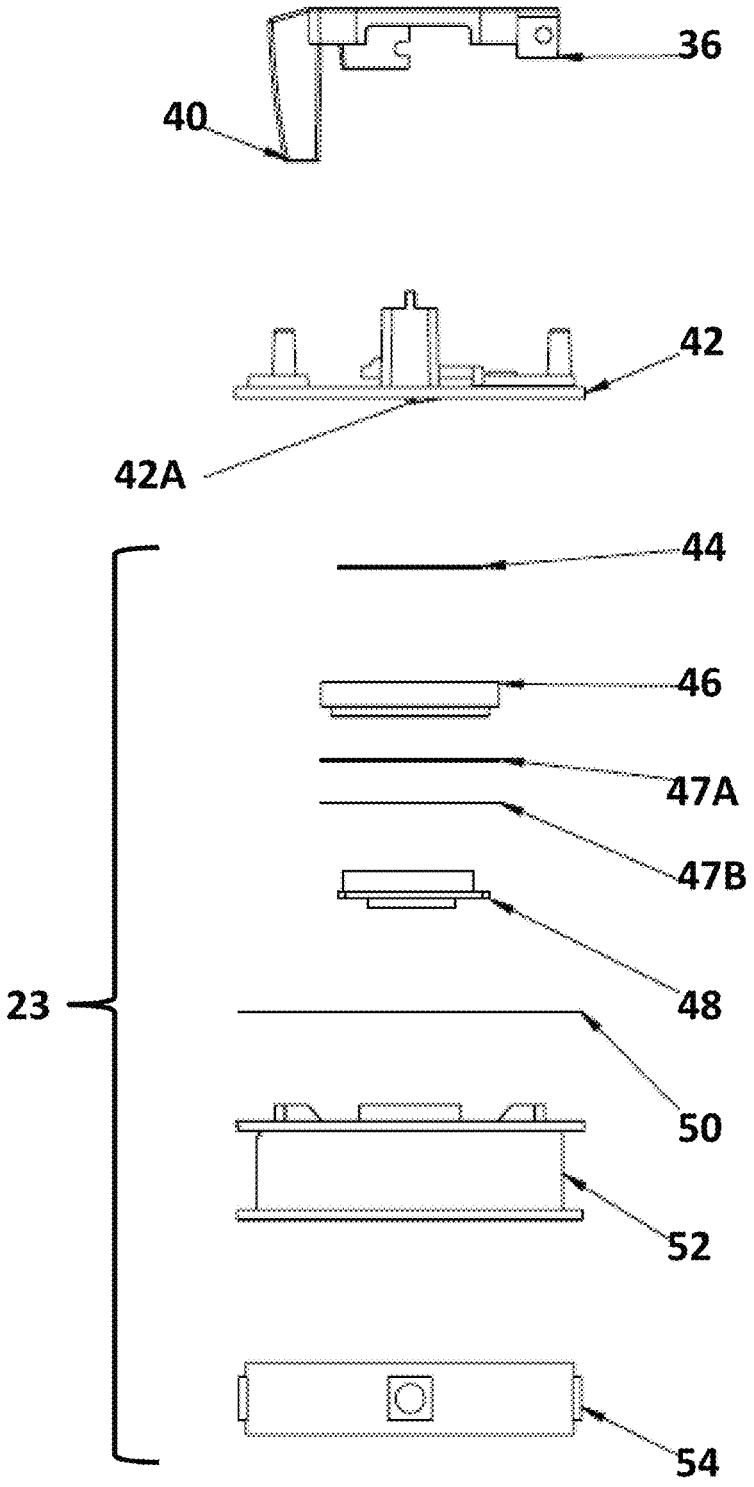
FIG. 5C illustrates further details of the electromechanical locking mechanism.
Figure 5D:
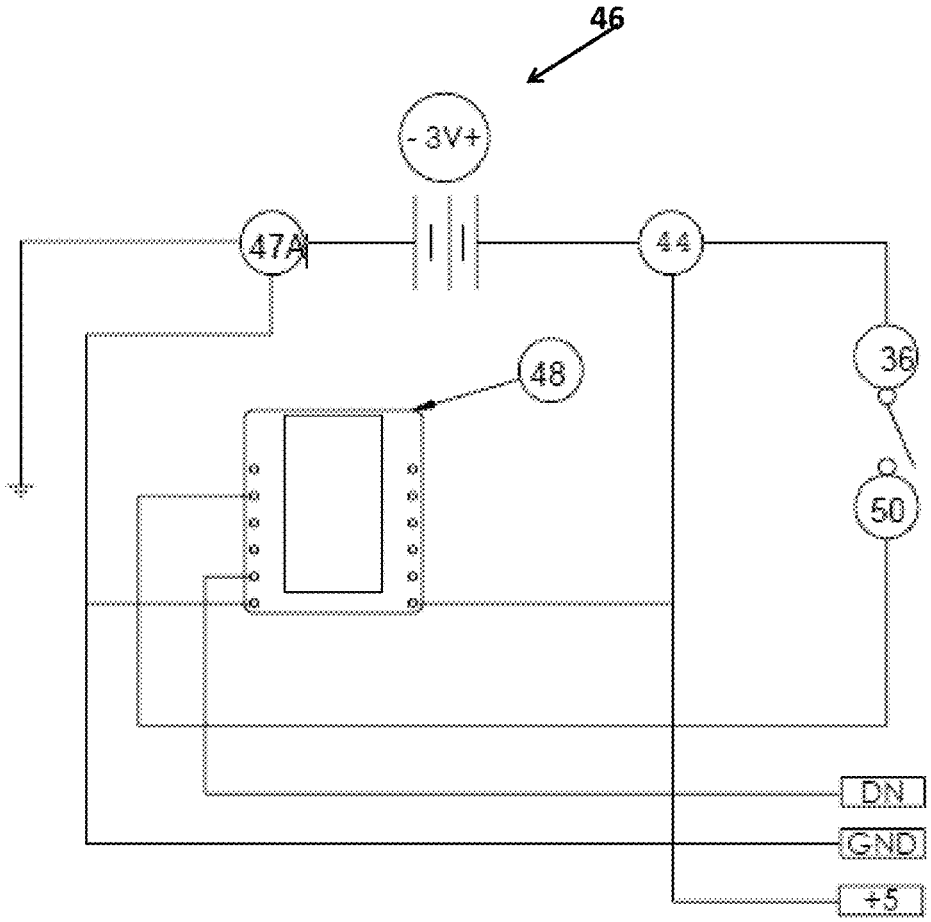
FIG. 5D is an electrical wiring diagram of the electromechanical locking mechanism.

FIG. 5C illustrates further details of the electromechanical locking mechanism 23 and its placement relative to the lock plate 36 and the dog plate 52. In this embodiment of the locking cap, a bottom portion 40 of the arm of the lock plate 36 may have a copper switch contact that completes the circuit as shown in FIG. 5D. The electromechanical locking mechanism 23 may also have a tension plate 42 and the tension plate may have a contact spring 42A that allows articulation of the cap and brings power to the lock plate switch 40. The electromechanical locking mechanism 23 may also have a power plate 44 that rests on one side of a power source 46, such as a battery, a ground plate 47A that touches the other side of the power source and an electrical shield 47B that protects a processor 48 that is part of the electromechanical locking mechanism 23. The electromechanical locking mechanism 23 may also have a dog plate piece of copper 50 that is underneath the processor 48 and a dog cap/plate 52 that is underneath the copper piece 50. The electromechanical locking mechanism 23 may also have a light strip 54 underneath the dog cap 52, such as an 3M LED strip that can provide visual indications as described elsewhere and is controlled by the processor 48. The electrical wiring diagram of the electromechanical locking mechanism 23 is shown in FIG. 5D.

As described above for the first embodiment, this embodiment of the locking cap 24 has the electronic circuits 32 (shown in FIG. 6 that are part of the electromagnetic locking components 52) that may include one or more sensors including a capacitive touch sensor, the one or more visible indicators 600 (shown in FIG. 6), such as LEDs, and connectivity circuits, such as a Bluetooth receiver, that allows the electronic circuits 32 to communicate with an external device. The electromagnetic locking components 52 (including the electronic circuits 32) may, for example, actuate the lock/unlock device located in a cap 30 based on users' schedule, may light up different lights in the cap to indicate a medication taking status for the user of the locking cap. The electromagnetic locking components 52 also may send notifications, such as a need of the user to take medication or action now, late for medication or action or notification that a taking, medication or action taken on time. The electromagnetic locking components 52 may also be used to communicate pill taking status and time/log from the locking cap 24 to a mobile device, such as a phone, smartphone device such as an Apple iPhone or Android operating system based device, a tablet computer, a person computer and the like) of a care taker, doctor and/or hospital. The locking cap may use a capacitive touch sensor to monitor pill taking status. The locking cap may also provide secure authentication of user based on data collected from the registered mobile device and electromagnetic locking components 52 in the cap. The electromagnetic locking components 52 may also include software (a plurality of lines of computer code or microcode) that may be executed by the processor of the electromagnetic locking components 52 to configure the processor to provide different functions. For example, the software may provide interfaces with time, frequency, compliance and reporting systems and may provide authentication of authorized users. The electromagnetic locking components 52 may store information both when it is used to open the closure and when the mechanical combination may be used to open the locking cap. The processor of the electronic circuits is contained within the combination locking closure, together they allow multiple ways for a user to access the substance requiring security. Thus, the locking cap provides a mechanical and digital locking mechanism to protect medications and other substances by putting in the container with the lock.

The locking cap may register with remote devices/emails/websites/corporate systems. Thus, the locking cap may be used with digital health records or any electronic record system. The locking cap thus can be used for compliance on controlled substances and it can be used for reporting proper and improper uses of the medication/substance. The remote use of any bottle or container can be used that may need reporting or compliance or just provide information. In addition, employee management is another use of the locking cap.

While the foregoing has been with reference to a particular embodiment of the disclosure, it will be appreciated by those skilled in the art that changes in this embodiment may be made without departing from the principles and spirit of the disclosure, the scope of which is defined by the appended claims.

The invention claimed is:

1. A cap lock attachable to a container, comprising:

a cap portion that has an upper surface with a plurality of first gaps therein;

a rotatable dial lock mounted in the housing, said rotatable dial lock having two or more cogs having symbols thereon and cams in mechanical relationship with each other to allow the cogs to spin and wherein the cogs are settable to a plurality of symbol combinations that allow the cap lock to be manually opened by entering an unlock sequence of symbols on the cogs;

a dog plate, mounted to the housing that freely rotates within the housing, the dog plate having one or more features that allow sufficient torque to be exerted to rotate the cap when the lock is open;

a locking plate, above the rotatable dial lock, having a plurality of second gaps and pivotally mounted to the housing, the locking plate being movable between a locked position and an unlocked position and wherein the plurality of second gaps are in alignment with said plurality of first gaps whereby said cogs are held in place by said plurality of first gaps and said plurality of second gaps;

an electromechanical locking portion within the housing having at least a processor and a device wherein the device is capable to electromechanically placing the locking plate into the unlocked position or the unlocked position; and the locking plate being placed in said unlocked position when the cogs are set to the unlock sequence of symbols on the cogs or by the electromechanical locking portion device, and the locking plate being placed in said locked position when the cogs are not in the unlock sequence of symbols on the cogs or the electromechanical locking portion has put the locking plate in the locked position.

2. The cap lock of claim 1, wherein the locking plate having a reset access by which the unlock setting of the cogs can be reset when the locking plate is in the unlocked position and an arm of the locking plate, when the locking plate is in the locked position, blocking the reset access.

3. The lock cap of claim 1, wherein the processor receives a command to unlock the locking cap that is current locked on to a container and activates the device within the housing that electromechanically unlocks the locking cap so that it is removable from the container.

4. The lock cap of claim 3, wherein the device is a solenoid that is activated by the processor to the solenoid.

5. The lock cap of claim 4, wherein the solenoid moves the lock plate to an unlocked position when the solenoid is activated to open the locking cap.

6. The lock cap of claim 1 further comprising one or more visual indicators that generate an indication of a status of medication.

7. The lock cap of claim 1 further comprising a wireless communication circuit connected to the processor that communicates with a computing device external to the housing of the lock cap.

8. A method, comprising:

receiving, at a processor of a locking cap, a command to unlock the locking cap that is current locked on to a container;

activating, by the processor, a device within a housing of the locking cap that electromechanically unlocks the locking cap so that it is removable from the container; and manipulating a set of cogs to manually open the locking cap.

9. The method of claim 8, wherein activating the device to unlock the locking cap further comprises activating a solenoid by providing an electrical signal from the processor to the solenoid.

10. The method of claim 8 further comprising moving a lock plate to an unlocked position when the solenoid is activated to open the locking cap.

11. The method of claim 8 further comprising moving a lock plate to an unlocked position when the set of cogs are in an unlock position to open the locking cap.

12. The method of claim 8 further comprising generating a visual indication on the housing of the container a status of medication.

13. The method of claim 12, wherein generating the visual indication further comprises energizing, by the processor, one or more light emitting diodes.

14. The method of claim 8 further comprising communicating, by the processor, with an external device.

* * * * *